US005980290A

United States Patent [19]

Meynier et al.

[11] Patent Number: 5,980,290

[45] Date of Patent: Nov. 9, 1999

[54] COAXIAL ELECTRIC CONNECTOR ELEMENT WITH MOVABLE CONTACT AND COAXIAL ELECTRICAL CONNECTOR COMPRISING SUCH A CONNECTOR

[75] Inventors: Christophe Pierre Louis Meynier, Saint-Egreve; Patrick Luc Marcel Leleu, Saint Nicolas de Macherin, both of France

[73] Assignee: Radiall, Rosny-Sous-Bois, France

[21] Appl. No.: 09/009,464

[22] Filed: Jan. 20, 1998

[30] Foreign Application Priority Data

Jan. 20, 1997 [FR] France ..... 97 00529

[51] Int. Cl.[6] ..... H01R 13/64

[52] U.S. Cl. ..... 439/246; 439/8

[58] Field of Search ..... 439/246, 248, 439/249, 252, 6, 8, 675

[56] References Cited

U.S. PATENT DOCUMENTS

| | | | |
|---|---|---|---|
| 2,519,933 | 8/1950 | Rouault | 439/8 |
| 2,972,728 | 2/1961 | Cole | 439/246 |
| 4,697,859 | 10/1987 | Fisher, Jr. | 439/248 |
| 4,815,986 | 3/1989 | Dholoo | 439/248 |
| 5,276,750 | 1/1994 | Manning | 385/56 |

FOREIGN PATENT DOCUMENTS

| | | | |
|---|---|---|---|
| 0159116 | 10/1985 | European Pat. Off. . | |
| 55473 | 2/1968 | Luxembourg . | |
| 1072159 | 2/1984 | U.S.S.R. | 439/247 |
| 2024531 | 1/1980 | United Kingdom | 439/252 |
| 2218271 | 11/1989 | United Kingdom . | |
| 8904984 | 6/1989 | WIPO . | |

*Primary Examiner*—Paula Bradley
*Assistant Examiner*—Tho D. Ta
*Attorney, Agent, or Firm*—Schweitzer Cornman Gross & Bondell LLP

[57] ABSTRACT

The invention relates to a coaxial connector element capable of coupling by translation along a coupling direction (23) with an associated coaxial electric connector element and comprising an electrically conductive outer body (8) intended to serve as outer conductor, a central conductor (11), fixed with respect to the outer body and located within the body and insulated from it and, on a face known as the coupling face of the connector element, a coaxial contact element comprising an outer contact (14) connected to the outer conductor, which is constituted by the body, and a central contact (12) connected to the central conductor. It comprises, between the outer contact (14) and the body (8) or between the central contact and the central conductor, an articulation, which permits the contact in question (14) to orient itself without being deformed in different directions forming an angle other than zero with the direction of coupling (23) of the connector element.

5 Claims, 8 Drawing Sheets

COAXIAL ELECTRIC CONNECTOR ELEMENT WITH MOVABLE CONTACT AND COAXIAL ELECTRICAL CONNECTOR COMPRISING SUCH A CONNECTOR

FIELD OF THE INVENTION

The present invention relates to a coaxial electric connector element with movable contact and a coaxial connector comprising such a connector element.

BACKGROUND OF THE INVENTION

It is known that the prior-art coaxial electric connectors of the type shown in FIGS. 1 to 3 comprise two connector elements, each formed by an electrically conductive body 41, 42, a central conductor 43, 44 located within the body and insulated from it and, on one face 45, 46, known as the coupling face, of the connector element, a coaxial contact element comprising an outer contact 47, 48 connected to the body, or forming an integral part of the body, and a central contact 49, 50 connected to the central conductor 43, 44, both the outer contact and the central contact being coaxial, centered on the axis 51, 52 of the connector element and making it possible to assure the connection with the associated electrical connector element.

In the known connectors, the connecting of the two connector elements can take place only if the two connector elements are brought together with their coupling faces 45, 46 facing each other and with their axes 51, 52 correctly merged along a coupling direction, as shown in FIGS. 1 and 2.

However, under certain circumstances, the two connector elements cannot be brought close to each other with their coupling axes 51, 52 strictly on-line.

In particular, this is true of basket-end connectors, which serve to connect electric devices mounted in slide-shaped housings to electric cables or other electric devices.

Basket-end connectors comprise in each case a connector element mounted on the rear wall of the housing and a connector element mounted on the end wall of a recess intended to receive this housing.

Upon the insertion of the housing into the recess, these two parallel walls come into the vicinity of each other, and the two connector elements are coupled to each other.

It will be understood that this coupling is effected without it being possible to see the connector elements nor to intervene on them, which is referred to by the expression "blind coupling".

Due to this "blind" coupling, it is not possible to note that the two connector elements are out of line at the time that they are brought together, either due to their mounting or by reason of a slight shift resulting from play between the housing and the recess.

When there are only slight angular variations between the axes of the connector elements, the elasticity of the outer and central contacts of each connector element is sufficient to tolerate the lack of alignment.

On the other hand, when the angular variations are greater, for instance, on the order of 5 degrees, as is shown in FIG. 3, it is not possible to couple the two connector elements without the danger of irreversibly deforming them or breaking them.

EP-A-0159116 describes a floating coaxial connector element intended to be mounted on the end of the basket. This connector element comprises a movable central contact and a rigid outer contact, which are fixed with respect to each other and mounted floating via a coil spring in a fastening cup secured to an end panel.

Such a connector element solves the alignment problem described above, but it can only be mounted on a cable, the end of which can move in order to follow along in the movements of the floating connector element upon the coupling.

Furthermore, this connector element is expensive and bulky.

The present invention is directed at providing a coaxial connector element, which solves the alignment problem described above in a different manner, so as to be compatible not only with a cable, but also with a fixed, rigid coaxial conductor, while not taking up much space and being as simple and economical to produce.

OBJECT OF THE INVENTION

The object of the present invention is a coaxial connector element adapted to be coupled by translation along a coupling direction with an associated coaxial contact connector element and comprising an electrically conductive outer body intended to serve as outer conductor, a central conductor fixed with respect to the outer body, located within the body and insulated from it and, on the so-called coupling face of the connector elements, a coaxial contact element comprising an outer contact, which is constituted by the body, and a central contact connected to the central conductor, characterized by the fact that it comprises, between the outer contact and the body or between the central contact and the central conductor, an articulation, which permits the contact in question to orient itself without deforming in different directions, forming an angle other than zero with the coupling direction of the connector element.

SUMMARY OF THE INVENTION

Thus, one can couple the connector element of the invention with an associated connector element, the axis of which forms an angle other than zero with the axis of the connector element of the invention.

At the beginning of the coupling phase between the two connector elements, the outer contact and/or the central contact of the connector element of the invention is oriented in such a manner as to be centered on the axis of the associated connector element, whereupon the coupling phase can be completed under the same conditions as though the associated connector element were presented in the direction of coupling of the connector element in accordance with the invention.

The inventive connector element has the advantage of retaining the electrical characteristics of a traditional connector, in particular with respect to the electromagnetic shielding, due to the fact that the coupling of the contacts takes places under good conditions, which is not true of a rigid connector element, which becomes deformed in case of a coupling, which is out of line.

Preferably, the inventive connector element comprises an articulation on at least its outer contact since the latter has larger dimensions than the inner contact and is generally less apt to deform elastically in order to tolerate a lack of alignment of the two connector elements upon their coupling.

In this case, the central male contact of the connector, which is present on the connector elements provided with the articulated outer contact on the associated connector elements, can comprise a bulb at its end, so as to constitute a ball joint with the female central contact of the other connector element, due to the fact that said bulb can assume different orientations within said female contact.

Thus, neither the outer contacts nor the central contacts of the connector have to withstand any stress in the case of an out-of-line coupling of the two connector elements.

In a preferred embodiment of the invention, the articulation, which permits the orientation of the contact, is a ball joint, which permits rotation of said contact around a fixed point located substantially on the axis of the connector element.

This rotation preferably takes place within a solid angle of about 10 degrees.

For example, the ball joint is obtained by imparting a spherical shape to the outer surface of the contact and by enclosing this contact in a recess, the inner wall of which is tangent to the spherical outer surface of the contract. The contact is advantageously slightly force-fitted in the recess so as to assure a better elastic connection between said contact and said recess.

The present invention also has as its object a coaxial electrical connector comprising two connector elements, at least one of which comprises an articulation such as described above.

BRIEF DESCRIPTION OF THE DRAWINGS

In order better to understand the invention, an embodiment will now be described, which is given by way of illustration and not of limitation, reference being made to the accompanying drawing, in which:

FIGS. 1 to 3 illustrate the prior art, which has already been commented on;

DETAILED DESCRIPTION OF THE INVENTION

Figure 1:
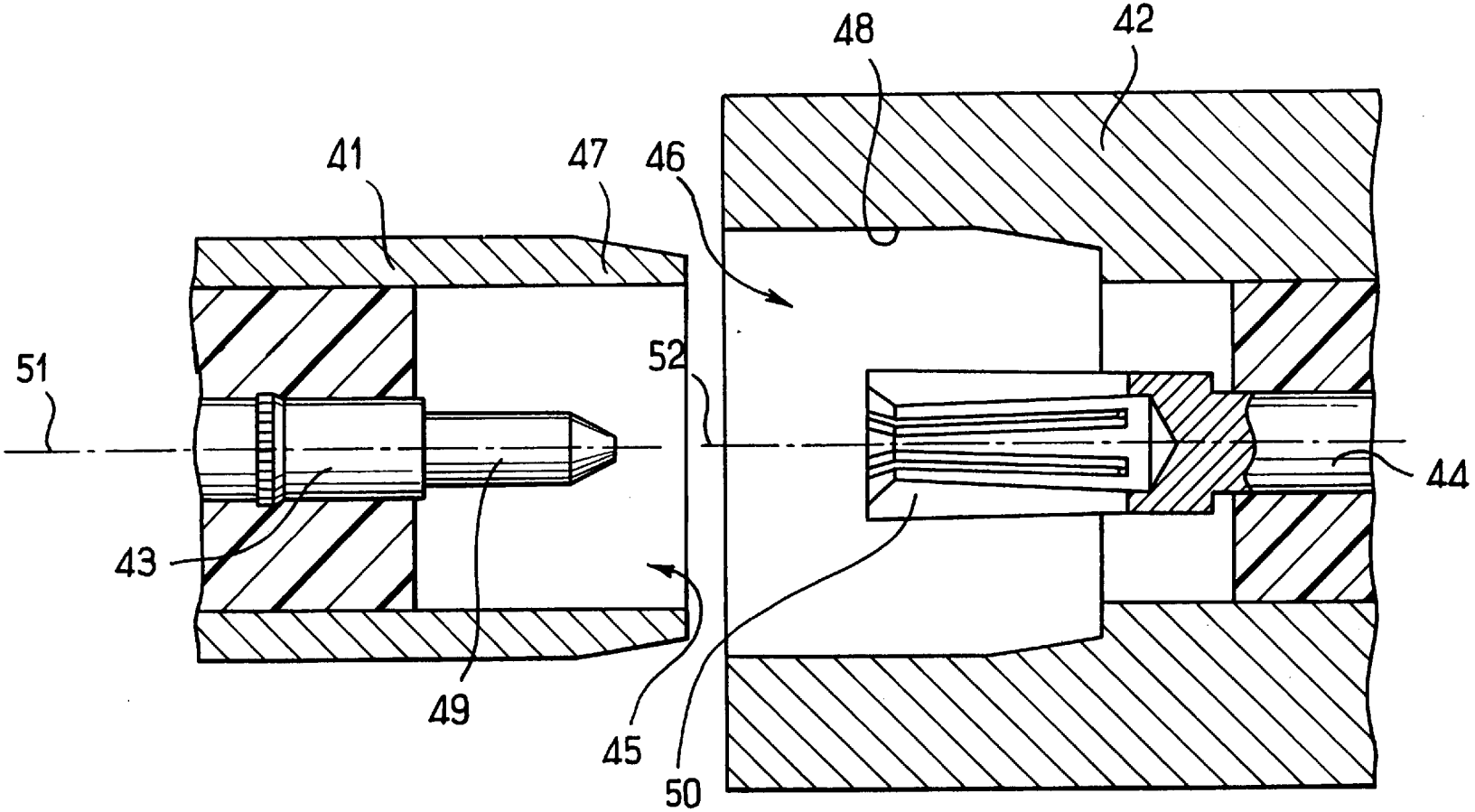
FIG. 1 PRIOR ART
Figure 2:
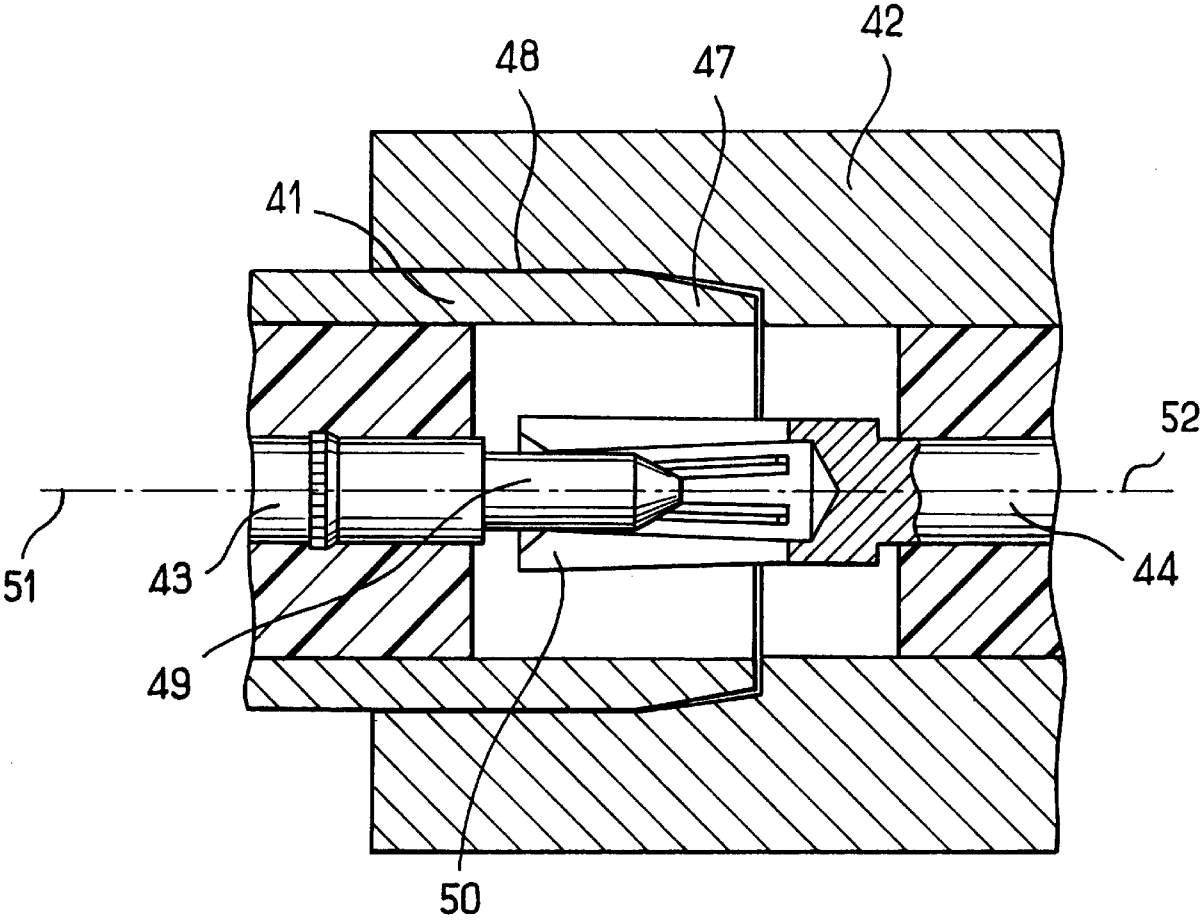
FIG. 2 PRIOR ART
Figure 3:
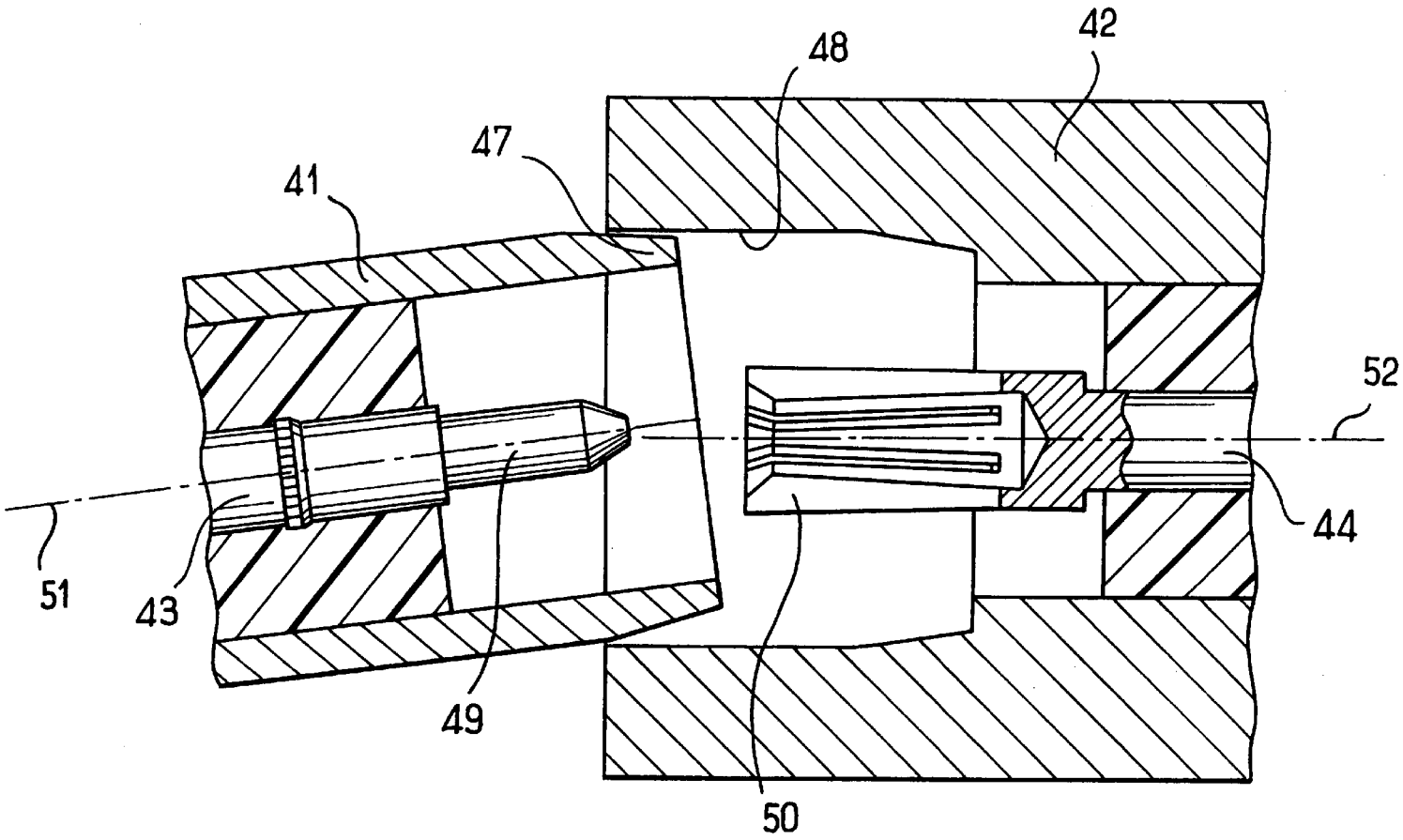
FIG. 3 PRIOR ART
Figure 4:
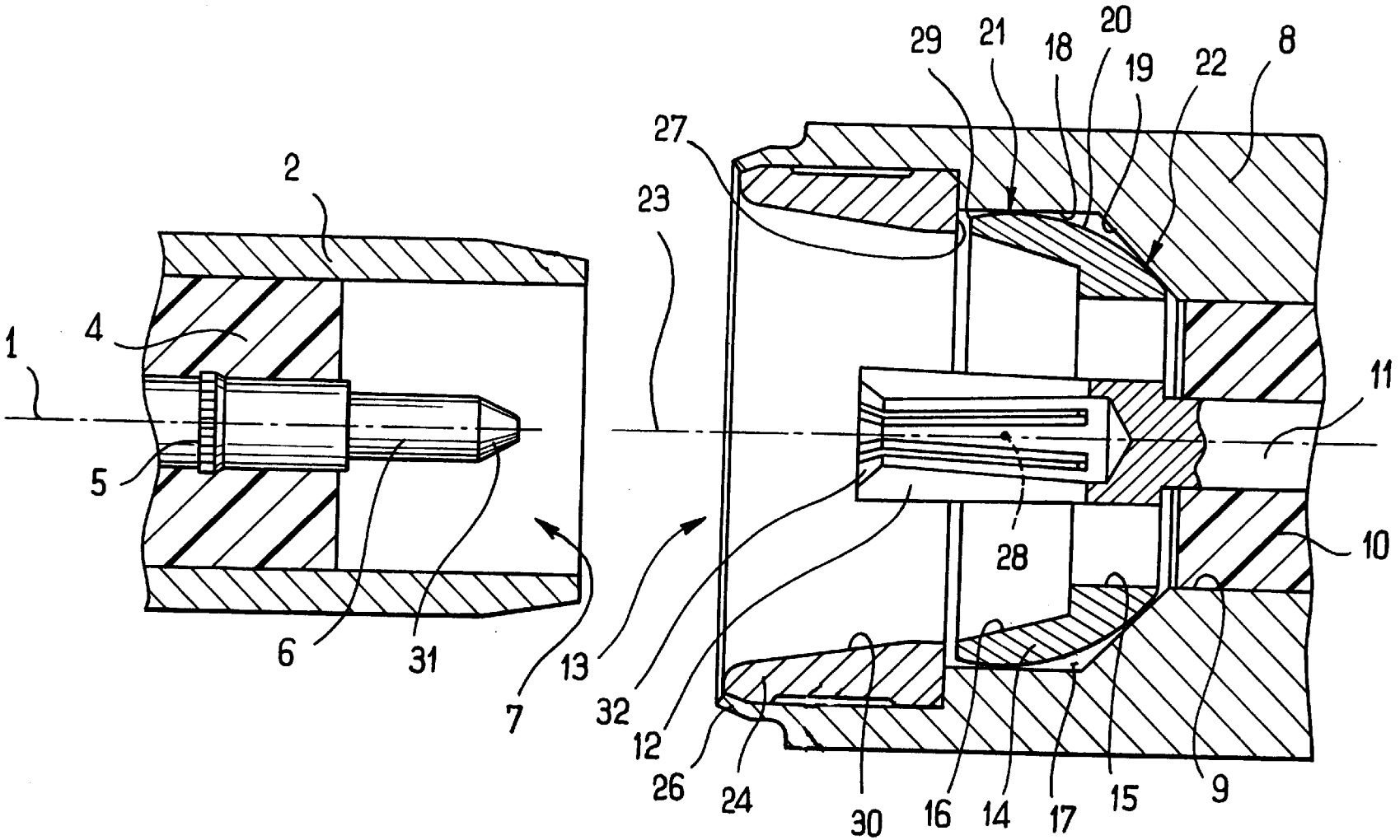
FIG. 4 shows an axial section, a coaxial electrical connector according to the invention before the coupling of the two aligned connector elements.

The connector element located to the left in FIGS. 4 to 7 is a rigid connector element of axis 1 of the prior art, identical to that of FIGS. 1 to 3.

It comprises an outer conductor body 2, the front portion 3 of which, having the shape of a bushing, constitutes an outer contact, a tubular insulator 4 of plastic material enclosed in the body and a central conductor 5 arranged within the body and held by the insulator, extended by a central contact 6 in the form of a pin which, together with the outer contact 3, constitutes a male coaxial contact element protruding from the connecting face 7 of the connector element.

The connector element located to the right in FIGS. 4 to 7 also comprises an electrically conductive body 8 of tubular shape, which defines a central passage 9, a tubular insulator 10 housed within this passage and a central conductor 11 held by the insulator within the body.

The central conductor 11 is extended by a central contact 12, in the direction towards the connecting face 13 of the connector element.

This central contact 12 is formed by a slit bushing, which has a certain elasticity enabling it both to clamp the pin 6 constituting the central contact of the associated connector element and to tolerate misalignments of the two connector elements upon their coupling.

An outer contact 14 is formed by a hollow part having the outer shape of a portion of a sphere, said hollow part being traversed internally by a cylindrical passage 15 and a coaxial frustoconical passage 16.

The cylindrical passage 15 permits the central contact 12 to pass through the outer contacts 14, so that the latter surrounds the central contact.

Figure 5:
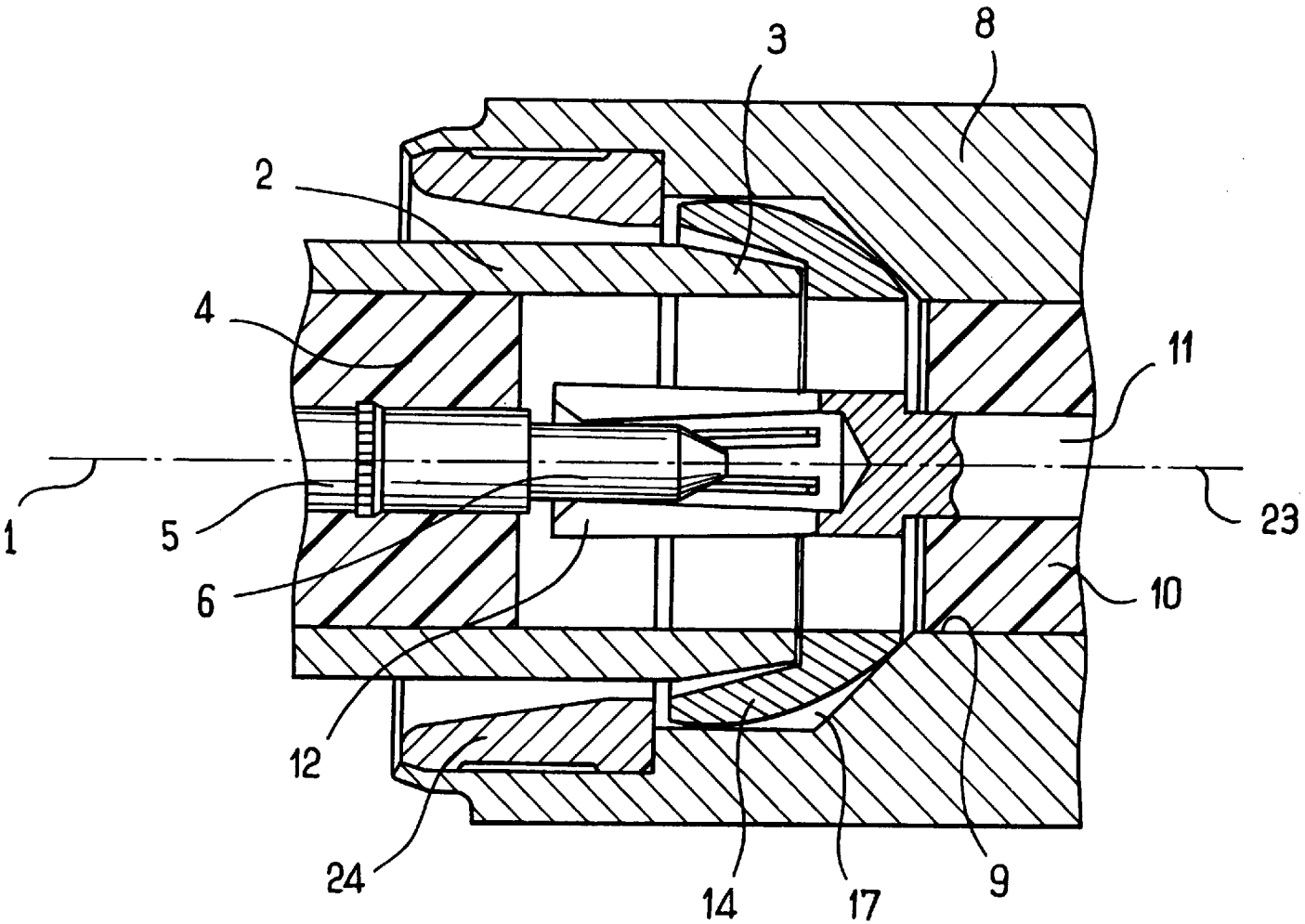
FIG. 5 is a view similar to FIG. 4 after the coupling of the two aligned connector elements.
Figure 7:
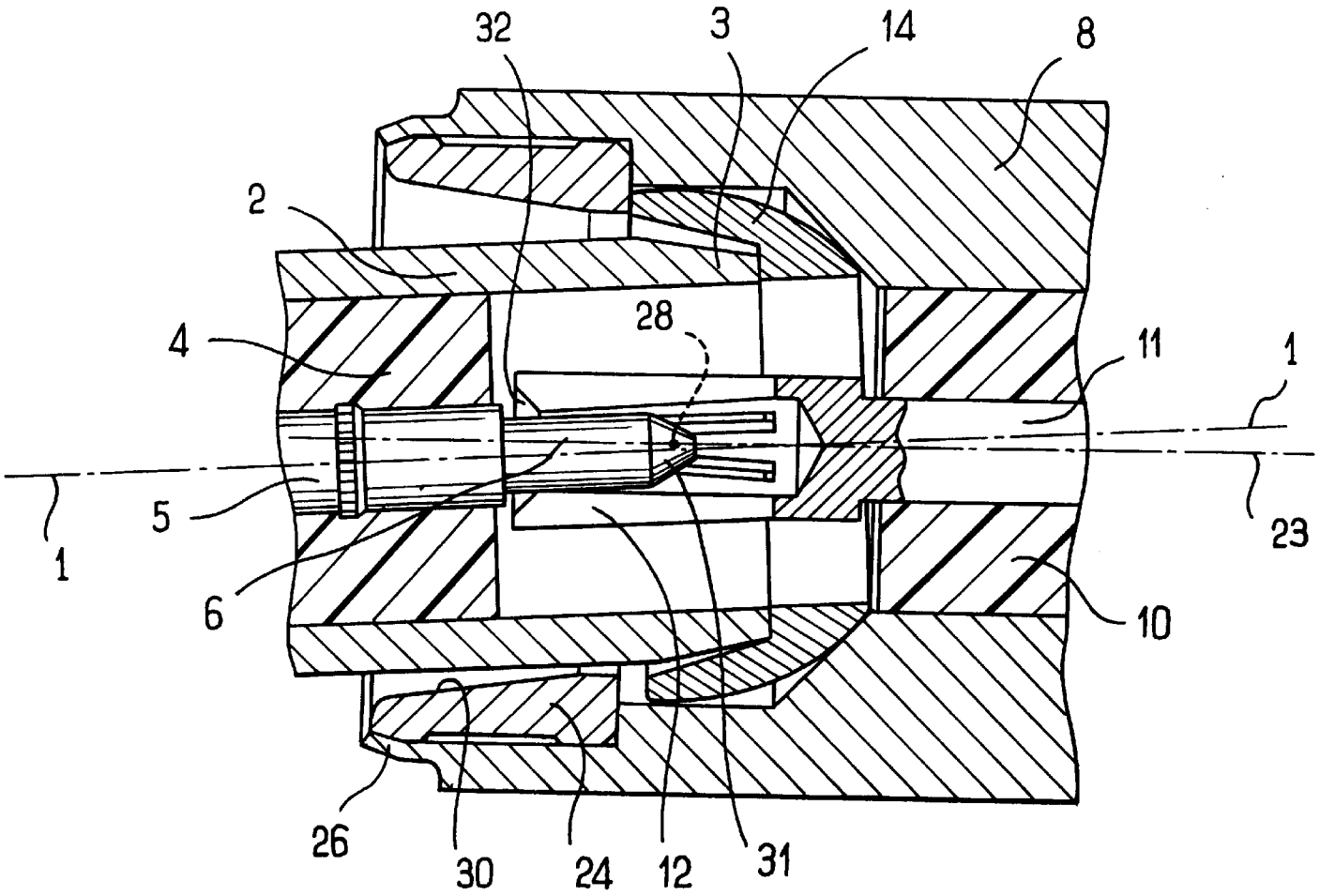
FIG. 7 is a view similar to FIG. 6 after the coupling of the two misaligned connector elements.
Figure 8:
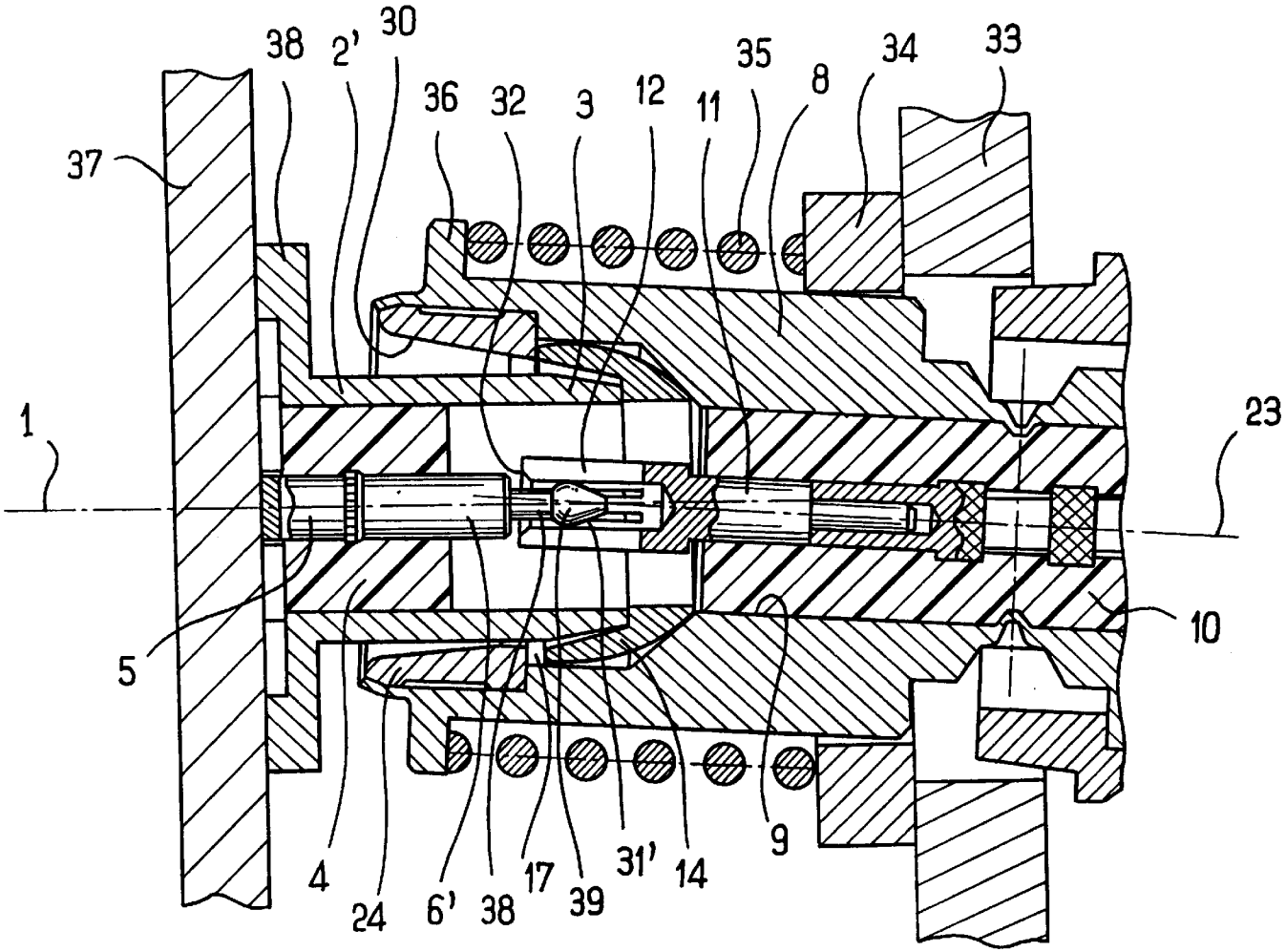
FIG. 8 is a view similar to FIG. 7, showing a variant embodiment of the connector.

The frustoconical passage 16 is adapted to receive the outer contact 2 of the associated connector element, as shown in FIG. 5, 7 and 8.

The articulated outer contact 14 and the central contact 12 of the connector element form a female coaxial contact element adapted to cooperate with the male contact element of the associated connection element.

The female outer contact 14 is enclosed within a recess 17, which is defined by a cylindrical portion 18 of the same diameter as the spherical outer portion of the outer contact 14 and by a frustoconical portion 19 facing the connecting face 13, which connects the cylindrical section 15 with the central passage 9 the body.

The cylindrical section 18 and the frustoconical section 19 of the recess are tangent to the outer surface 20 of the outer contact along two circles 21, 22 centered on the axis 23 of the connector element.

The axis 23 defines the direction of coupling of the connector element.

A ring 24 is housed within the mouth of the outer conductive body 8 within an annular recess 25 located in front of the recess 17 provided for the outer contact 14.

This ring 24, which is clamped in said recess by deformation of the front edge 26 of the body, has a rear radial wall 27 forming a stop for the outer contact 14, which is thus prevented from falling out of its recess 17, within which it can nevertheless carry out rotations around the center 28 of the sphere, which defines its outer surface, this center being located on the axis 23 of the connector element.

The outer contact 14 is therefore articulated on the body 8.

The thickness of the radial wall 27 of the ring 24 is at least equal to the thickness of the front face 29 of the articulated outer contact 14 so that said front face 29 never protrudes towards the inside with respect to the inner wall 30 of the ring.

Thus, the other contact 3 of the associated connector element does not run the risk of striking against the front face of the articulated outer contact 14 upon the coupling.

The inner wall 30 of the ring 24 is frustoconical, so as to assure, upon the coupling, the centering of the connector elements by guidance of the male outer contact 3 until said male outer contact 3 comes into contact with the articulated female outer contact 14.

Upon a conventional coupling, that is to say when the two connector elements are presented with their coupling axes 1, 23 aligned, the male outer contact 3 and the male central contact 6 of the associated connector element assume their place in the articulated female outer contact 14 and the female central contact 12, as shown in FIG. 5.

Figure 6:
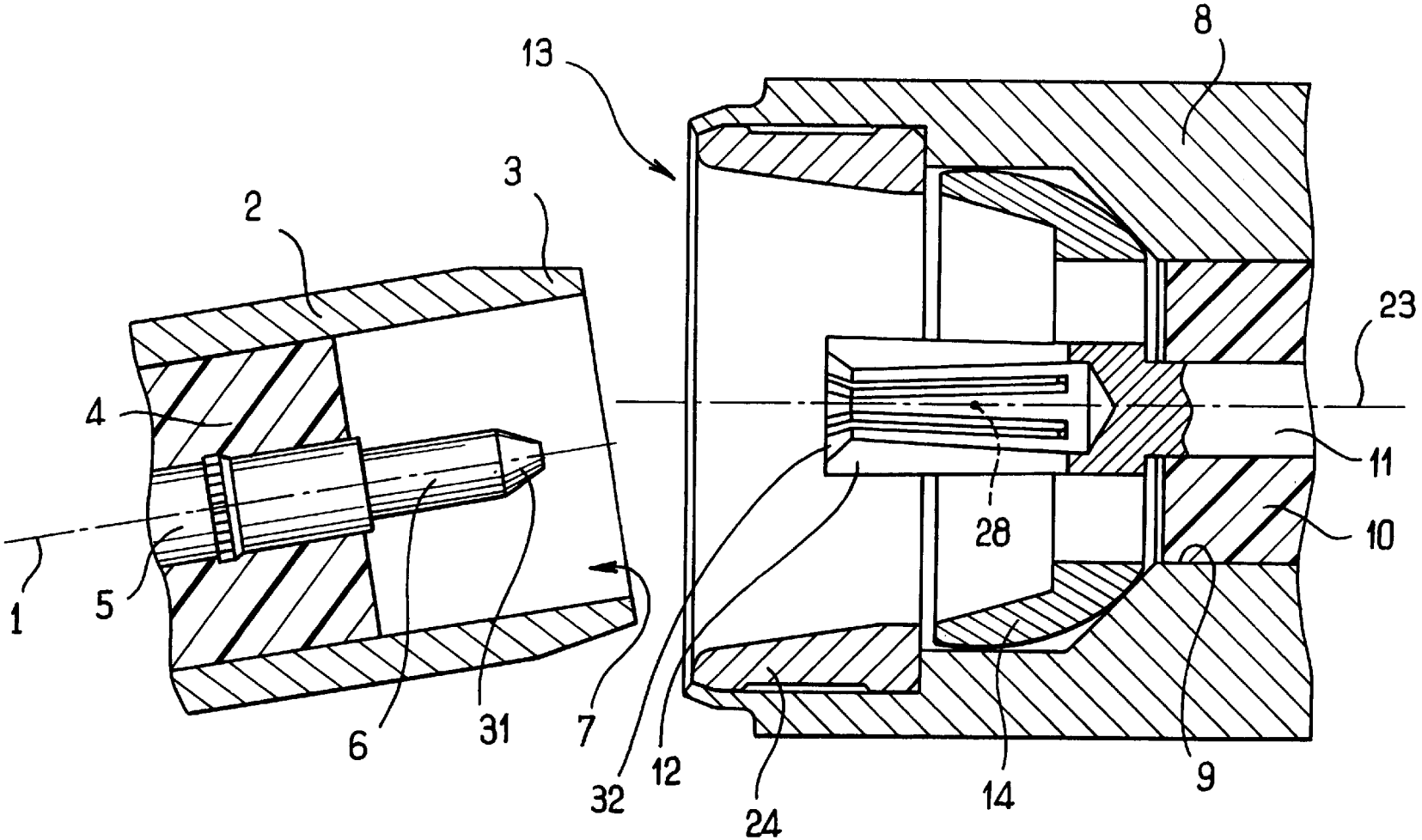
FIG. 6 is a view similar to FIG. 4, showing the two misaligned connector elements.

Upon an out-of-line coupling, that is to say when the connector elements present themselves with their axes 1, 23 askew, as can be noted in FIG. 6, the associated connector element first of all penetrates into the clamped ring 24, the frustoconical inner wall 30 of which guides the male outer contact 3 until it reaches the articulated female outer contact 14. In this phase of the coupling, the pin-shaped male central contact 6 penetrates by its frustoconical end 31 into the female central contact 12 of the inventive connector element, being guided by the chamfered mouth 32 of said female central contact.

The latter being elastic, it can deform sufficiently to tolerate the misalignment of the male central contact 6.

At the same time, when the male outer contact 3 comes to rest against the articulated female outer contact 14, it pushes the lower portion (referred to the drawing) back, which causes a rotation of the female outer contact, which is movable within its recess. Said articulated female outer contact 14 then automatically comes into alignment with the associated connector element axis, as can be noted from FIG. 7.

The coupling can then be completed, the male connector element engaging completely in the female connector element. Holding means (not shown) assure the holding of the connector in its coupled position.

In the case of a basket-end connector, that is to say, one in which the two connector elements are mounted on panels, one on the end wall of a slide recess and the other on the rear wall of a slide-shaped housing intended to be inserted in said slide recess, it is not useful to provide holding means specifically for the connector, since the holding of the slide pushed into its recess is sufficient to assure the holding of all the connectors located at the rear of the slide.

FIG. 8 shows a variant of the connector previously described, assembled as a basket end.

The female connector element, shown on the right in FIG. 8, is identical to that of FIGS. 4 to 7.

It is mounted on a wall 3, which constitutes the rear wall of a slide-shaped housing, by means of a ring 34, which is integral with said wall, on which a coil spring 35 rests in order to push the outer body 8 the connector element back by its collar 36 in the direction towards the end of the recess, which is intended to receive the slide.

This end is formed by a wall 37, on which the male connector element is mounted, its outer body 2' having a base 38 welded on said end wall 37.

The coil spring 35 has the function of assuring the coupling of the two connector elements and of absorbing a portion of the final stroke of the housing in its recess, this stroke being greater than the length of overlap of the two connector elements, so as to make certain that all the basket-end connectors of the slide are correctly connected.

As can be seen from FIG. 8, the mounting of the female connector element is loose, which permits a certain movement of said connector element with respect to the rear wall 33 of the housing, in order to permit the female connector element to take up any possible slight offset with the male connector element.

This take-up is assured by the centering surfaces provided between the two connector elements, namely the frustoconical wall 30 of the ring 24 and the frustoconical mouth 32 of the central contact 12 on the female connector element, and the front frustoconical section of the outer contact 30 and the substantially frustoconical end 31 of the central contact 6' on the male connector element.

At the time of the centering of the two connector elements, their axes, which are to be aligned, are askew.

The articulation of the female outer contact enables it to accommodate itself to this misalignment while preserving the outer contacts from any flexural stress, as has already been described with reference to FIGS. 4 to 7.

In the variant shown in FIG. 8, the male central contact comprises, at its end, a narrowing in cross section 38 terminated by a bulb 39 of ovoidal section, the part of which, directed towards the front of the contact, being tapered and forming the substantially frustoconical end 31' already mentioned.

The bulb 39 is so dimensioned as to be able to engage in the female contact 12, the radial elasticity of which assures good electrical connection with said bulb by tangent contact with the latter.

The quasi-spherical shape of the bulb around this tangent contact zone as well as the clearance produced by the narrowing of cross section 38, permit a rotation of said bulb within the female contact, so that the connection between the male contact and the female contact is similar to a ball joint.

Thus, the central contacts are—like the outer contacts—preserved from any constraint related to the fact that the two connector elements are coupled while misaligned.

It is understood that the embodiment, which has just been described, is not of a limitative character and that it may be modified in any manner desired without thereby going beyond the scope of the invention.

In particular, it is clear that the ball joint connection described here can be obtained by other means, in particular by eliminating the ring 24 and clamping the conductor body 8 in such a manner, that it directly forms the stop, which prevents the movable outer contact from leaving its recess.

Furthermore, if the female central contact 12 is of insufficient elasticity, a ball joint connection similar to that described for the outer contact 14 could be provided between this central contact and the central conductor.

Furthermore, it is obvious that whether the contacts described are of male or female character is not of a limitative character.

We claim:

1. A coaxial connector element for coupling with an associated coaxial connector element by translation along a coupling direction, the coaxial connector element comprising:

an electrically conductive outer body forming an outer conductor element, a central conductor element fixed with respect to the outer body, the central conductor element being located within and being electrically insulated from the outer body, a central contact element electrically connected element to the central conductor, the central conductor element and the central contact element sharing a common axis, an outer contact element located within and electrically connected to the outer conductor element, and an articulation between the outer contact element and the outer body, which articulation permits the outer contact element to orient itself in different directions with respect to the outer body, thereby forming an angle other than zero with the common axis of the central conductor element and the central contact element.

2. The coaxial connector element of claim 1, wherein said outer body is mounted on a basket end.

3. The coaxial connector element of claim 1, wherein the articulation between the outer contact element and the outer body is a ball joint, which ball joint permits rotation of said outer contact element around a fixed point located substantially on the common axis of the central conductor element and the central contact element.

4. The coaxial connector element of claim 3, wherein the outer contact element has an outer surface with a partially spherical shape and the outer conductor element has a recess with an inner wall which is tangent to the outer surface of the outer contact element, thereby providing a ball joint between the outer conductor element and the outer contact element which maintains the electrical connection therebetween.

5. A coaxial connector assembly comprising:

first and second coaxial connector elements, the first coaxial connector element including, an electrically conductive outer body forming an outer conductor element, a central conductor element fixed with respect to the outer body, the central conductor element being located within and being electrically insulated from the outer body, a central contact element electrically connected to the central conductor, the central conductor element and the central contact element sharing a common axis, an outer contact element located within and electrically connected to the outer conductor element, and an articulation between the outer contact element and the outer body, which articulation permits the outer contact element to orient itself in different directions with respect to the outer body, thereby forming an angle other than zero with the common axis of the central conductor element and the central contact element, the second coaxial connector element including a central contact element in electrical connection with the central contact element of the first coaxial connector, one of the central contact elements of the first and second coaxial connector elements being a male contact element and another central contact element of the first and second coaxial connector elements being a female contact element, the male contact element having a bulb on an end thereof, the male and female contact elements forming a second ball joint which second ball joint permits the central contact elements to connect in a misaligned orientation.

* * * * *